US009653008B2

(12) United States Patent
Pelletier

(10) Patent No.: US 9,653,008 B2
(45) Date of Patent: May 16, 2017

(54) PORTABLE COLLAPSIBLE FABRIC-TENSIONED SIGN ASSEMBLY

(71) Applicant: Mead Pelletier, Cornwallville, NY (US)

(72) Inventor: Mead Pelletier, Cornwallville, NY (US)

(73) Assignee: MB Enterprises of Cairo, LLC, Cairo, NY (US)

( * ) Notice: Subject to any disclaimer, the term of this patent is extended or adjusted under 35 U.S.C. 154(b) by 0 days.

(21) Appl. No.: 15/151,438

(22) Filed: May 10, 2016

(65) Prior Publication Data

US 2016/0253932 A1 Sep. 1, 2016

Related U.S. Application Data

(63) Continuation of application No. 14/948,261, filed on Nov. 21, 2015, now Pat. No. 9,390,639, which is a continuation of application No. 14/492,104, filed on Sep. 22, 2014, now Pat. No. 9,262,949.

(51) Int. Cl.
*G09F 15/00* (2006.01)

(52) U.S. Cl.
CPC ..... *G09F 15/0012* (2013.01); *G09F 15/0018* (2013.01); *G09F 15/0025* (2013.01); *G09F 15/0062* (2013.01); *G09F 2015/0093* (2013.01)

(58) Field of Classification Search
CPC ..... G09F 15/0025
See application file for complete search history.

(56) References Cited

U.S. PATENT DOCUMENTS

| | | | |
|---|---|---|---|
| 3,335,984 | A | 8/1967 | Holland |
| 4,309,386 | A | 1/1982 | Pirsh |
| D273,346 | S | 4/1984 | Secon |
| 4,798,356 | A | 1/1989 | Alonso |
| 4,817,318 | A | 4/1989 | Strauch |
| 4,980,984 | A | 1/1991 | Kulp |
| 5,094,023 | A | 3/1992 | McVey |
| 5,131,609 | A | 7/1992 | Prouty |
| 5,152,091 | A | 10/1992 | Leach |
| 5,231,778 | A | 8/1993 | Belobraydich |
| 5,318,258 | A | 6/1994 | Lang |
| 5,551,178 | A | 9/1996 | Foley |

(Continued)

FOREIGN PATENT DOCUMENTS

| | | |
|---|---|---|
| CN | 201512753 U | 6/2010 |
| EP | 2025815 | 2/2009 |

OTHER PUBLICATIONS

Emergency Responder Products LLC website page (Jul. 17, 2013) www.emergencyresponderproducts.com/signstands.html.

*Primary Examiner* — Gary Hoge
(74) *Attorney, Agent, or Firm* — Thomas M. Owens, Esq.

(57) ABSTRACT

A portable collapsible sign assembly including a fabric covering and support frame which is adjustable between a collapsed and expanded position. When the sign assembly is expanded, or in its deployed state, the fabric covering and support frame possess a connective tension relationship with respect to one another which creates and supports both the sign assembly display sign and base in a stable manner. The fabric covering engagement with the support frame enables the entire sign assembly, including both the display sign and assembly base, to be simultaneously deployed in one user-initiated motion.

15 Claims, 15 Drawing Sheets

(56) References Cited

U.S. PATENT DOCUMENTS

| | | | | |
|---|---|---|---|---|
| 5,829,178 | A | 11/1998 | Hillstrom | |
| 6,003,256 | A | 12/1999 | Leach | |
| 6,244,011 | B1 | 6/2001 | Esser | |
| 6,332,284 | B1 * | 12/2001 | Tafforeau | G09F 15/0025 160/135 |
| 6,381,889 | B1 | 5/2002 | Knapp | |
| D459,871 | S | 7/2002 | Persson | |
| 6,463,687 | B1 | 10/2002 | Dorstewitz | |
| 6,755,381 | B1 | 6/2004 | Levin | |
| 6,785,991 | B2 | 9/2004 | Colip | |
| 8,117,776 | B1 | 2/2012 | Maus | |
| D664,760 | S | 8/2012 | Elder | |
| D669,677 | S | 10/2012 | Cohen | |
| 8,375,966 | B2 | 2/2013 | Kuelbs | |
| 8,522,805 | B2 | 9/2013 | Tan | |
| 8,590,190 | B2 | 11/2013 | White | |
| 8,616,932 | B2 | 12/2013 | Gelfond | |
| 8,720,457 | B2 | 5/2014 | Amairic | |
| 2001/0015399 | A1 * | 8/2001 | LaMotte | G09F 15/0025 248/165 |
| 2002/0104242 | A1 | 8/2002 | Haugen | |
| 2003/0029067 | A1 | 2/2003 | Dorstewitz | |
| 2003/0033743 | A1 | 2/2003 | Hillstrom | |
| 2003/0217496 | A1 | 11/2003 | Dicke | |
| 2004/0163293 | A1 * | 8/2004 | Hughes | G09F 15/0025 40/603 |
| 2004/0200103 | A1 * | 10/2004 | Dombrowski | G09F 15/00 40/603 |
| 2005/0017137 | A1 * | 1/2005 | Burris | G09F 15/0025 248/165 |
| 2005/0183304 | A1 * | 8/2005 | Kennedy | G09F 17/00 40/601 |
| 2006/0174525 | A1 * | 8/2006 | Hughes | G09F 15/0025 40/603 |
| 2008/0006746 | A1 | 1/2008 | Volochine | |
| 2008/0203257 | A1 * | 8/2008 | Bartholomew | G09F 15/0068 248/235 |
| 2009/0095337 | A1 * | 4/2009 | Carter | E04H 15/50 135/143 |
| 2009/0183408 | A1 | 7/2009 | Dicke | |
| 2010/0037499 | A1 * | 2/2010 | Hyung-Chul | G09F 11/30 40/606.01 |
| 2010/0325927 | A1 * | 12/2010 | Thorpe | G09F 17/00 40/610 |

* cited by examiner

PORTABLE COLLAPSIBLE FABRIC-TENSIONED SIGN ASSEMBLY

CROSS-REFERENCE TO RELATED APPLICATIONS

This application claims the benefit of U.S. patent application Ser. No. 14/948,261 (Filing Date of Nov. 21, 2015) which claims the benefit of the filing date of U.S. patent application Ser. No. 14/492,104 (Filing Date of Sep. 22, 2014).

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

BACKGROUND OF THE INVENTION

1. Field of the Invention

The present invention relates generally to signs and sign assemblies, and more specifically, to portable and collapsible sign assemblies requiring a reduced time and effort to assemble and deploy as compared to signs of a more permanent and fixed nature, particularly for use in emergency response and unexpected road traffic control situations.

2. Background Information

Portable and collapsible traffic control display signs and sign assemblies for warning motorists and pedestrians are well known in the prior art. The existing sign assemblies consist of two main components: a display sign which presents a message and a sign assembly base to support the message-bearing display sign. The display sign and sign assembly base are either permanently connected or can be manually connected when deploying the sign assembly for use. In general, these portable and collapsible sign assemblies are intended to be quickly deployed for a temporary duration and therefore, designed to be easily assembled, located, disassembled, and transported by small road crews or just one person. Examples in the prior art include U.S. Pat. No. 4,980,984 to Kulp et. al, U.S. Pat. No. 5,318,258 to Lang, U.S. Pat. No. 5,829,178 to Hillstrom, U.S. Pat. No. 5,094,023 to McVey, U.S. Pat. No. 6,381,889 to Knapp, U.S. Pat. No. 5,231,778 to Belobraydich et. al., U.S. Pat. No. 6,463,687 to Dorstewitz, U.S. Pat. No. 6,003,256 to Leach et. al., U.S. Pat. No. 5,551,178 to Foley et. al., and U.S. Pat. App. 2003/0033743 (Hillstrom). Additionally, sign assemblies and individual components of sign assemblies are offered for sale by numerous companies, including Emergency Responder Products, LLC.

However, despite the many advances achieved in portable and collapsible display signs and sign assemblies, there remain certain drawbacks in the prior art which the present invention is meant to address and overcome. Specifically, the prior art consists of sign assemblies in which the display sign and sign assembly base are designed as separate and distinct components which at most are related by a mechanical connection. Most of the prior art contemplates a traditional four-legged sign assembly base, while others disclose a tripod or A-frame sign assembly base. Regardless of the type of sign assembly base design in the prior art, the maximum extent of any relationship between the display sign and its support frame which communicates the intended message and the sign assembly base is in the form of a mechanical connection, such as a hinge or bracket which serves to connect the display sign support frame to the sign assembly base while the sign assembly is in its collapsed or deployed states, or both. While the prior art discloses portable and collapsible display sign assemblies, the unrelated nature of the display sign support frames and sign assembly bases disclosed in the prior art results in separate user actions being required in order to deploy both the display sign support frame which supports the message and the sign assembly base. These multiple steps required to deploy both the display sign support frame and the sign assembly base result in a more time-consuming and complex process to deploy the sign assembly. None of the prior art offers a portable and collapsible sign assembly in which a connective tension relationship exists between a fabric covering and all parts of the sign assembly frame, including both the display sign support frame and sign assembly base. This design, in which all components of the sign assembly possess a connective tension relationship to one another, enables the deployment of the entire sign assembly as a single composite unit in one user-initiated motion. By reducing the number of necessary steps to deploy both the display sign support frame and sign assembly base, the entire sign assembly becomes less complex and easier for users to deploy, can be more quickly deployed from its collapsed state, and more likely that users will use the sign assembly in needed situations rather than not using the sign assembly due to user intimidation caused by the complexity of deployment or a user belief that the sign assembly takes too long to deploy.

BRIEF SUMMARY OF THE INVENTION

The present invention overcomes the foregoing drawbacks of the prior art by providing an improved portable collapsible sign assembly including a fabric, or other type of material similar to fabric which is tear and rip resistant, covering and connecting to a single sign assembly support frame which supports and creates both the sign assembly display sign and sign assembly base. This design allows both the display sign support frame and the sign assembly base to be transitioned from a collapsed state to deployed state, and vice-versa, in one easy-to-perform action by the user, thereby enabling the entire sign assembly to be erected or collapsed with one user initiated and completed motion.

The sign assembly includes a polygon-shaped sheet of fabric, or fabric-like material, which interfaces in multiple places to a sign assembly support frame. The sign assembly support frame consists of six structural support members constructed of lightweight metal, plastic, composite or similar type of material and of such length that when the sign assembly is in an expanded or deployed state, the fabric and support frame act in tension with respect to each other to provide a stable sign assembly. In the sign assembly's collapsed state, the six structural support members are orientated in parallel directions, and may be folded or telescopically adjusted along the same direction, to reduce the storage size of the collapsed sign assembly. The sheet of fabric and the sign assembly support frame combine to expand simultaneously in one motion resulting in the fabric and sign assembly support frame creating a tension-stabilized portable and collapsible sign assembly.

In one embodiment, the fabric is permanently imprinted with a display sign message and different display sign messages can be displayed on the sign assembly by interchanging the fabric, with each such interchangeable fabric being imprinted with a different message.

In a second embodiment, the fabric has no imprinted display sign message. In this design, the fabric includes Velcro strips or other similar display sign message attachment means which combine with prongs on the sign assembly to enable the placement and removal of different display sign messages on the sign assembly without requiring the fabric to be changed.

It is an object of this invention to provide a sign assembly design which allows for easy expansion and collapsing of the sign assembly by a single person without any tools or special skills, with minimal effort in a minimal period of time. It is a further object of this invention to provide a design which allows the sign assembly to be manufactured easily and quickly with cost-effective, lightweight materials. It is a further object of this invention to provide a design which results in a sign assembly in its expanded or deployed state which is resistant to both natural wind or vehicle-induced air movements. Another object of the present invention is to provide a design which will decrease the number of injuries and deaths of emergency first responders and other individuals required to provide assistance on the roadways.

These and other objects, features and advantages of the present invention will become apparent from the following description when viewed in accordance with the accompanying drawings and claims.

REFERENCE NUMERALS IN DRAWINGS

1. Main Sheet
2. Upper Flap
3. Adjustable Tension Strap
4. Fabric Hole
5. Center Mast Slot Hole
6. Center Mast Support Frame Member
7. Semi-circular Channel Guide
8. Sliding Carriage
9. Upper Flap Support Frame Receiving Pocket
10. D-ring Containment Pin
11. Adjustable Tension Strap Hole
12. Articulating Rear Base Leg
13. Clasp
14. Adjustable Tension Strap Buckle
15. Upper Arm Extension Support Frame Member
16. Lower Leg Extension Support Frame Member
17. Center Shaft Support Frame Member
18. Prong or Tab
19. Articulating Rear Base Leg Connecting Pin
20. Front Ground Support Point
21. Eye Ring
22. Spring-loaded Pop Pin Mechanism
23. Support Frame Member to Semi-circular Channel Guide Connecting Pin
24. Center Shaft Support Frame Member Rear Hole
25. Center Shaft Support Frame Member Forward Hole
26. Velcro Strip
27. Interchangeable Display Sign
28. Interchangeable Display Sign Slots

DETAILED DESCRIPTION OF THE INVENTION

Figure 1:
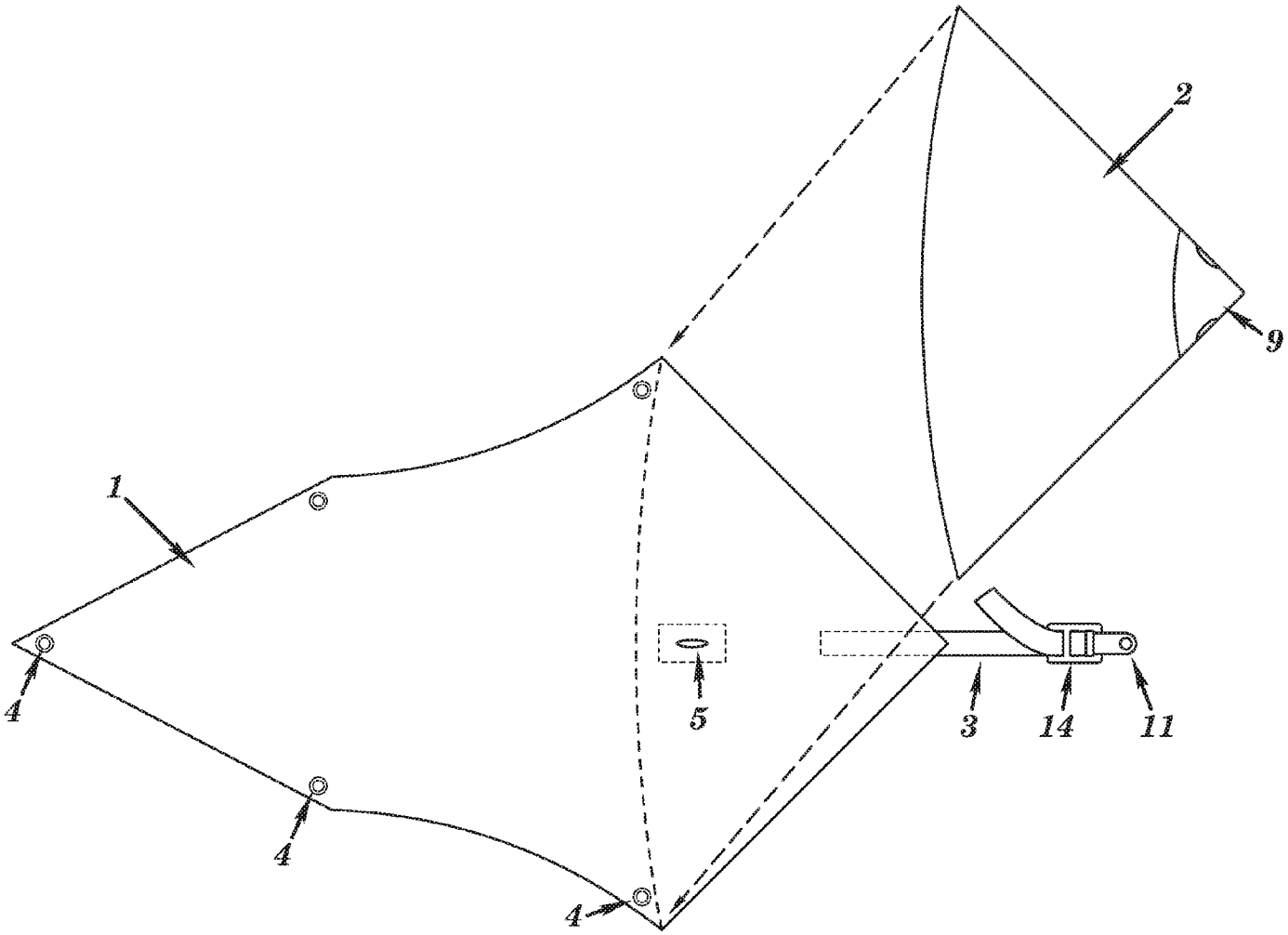
FIG. 1 is a view of the sign assembly fabric detached from the sign assembly.

Referring to the drawings, different aspects of the invention are shown in FIGS. 1 through 10. As shown in FIG. 1, the sign assembly fabric is constructed of lightweight fabric material, such as rip-stop nylon or other lightweight strong fabric-like material, and includes a main sheet (1), an upper flap (2) and an adjustable tension strap (3).

Figure 3:
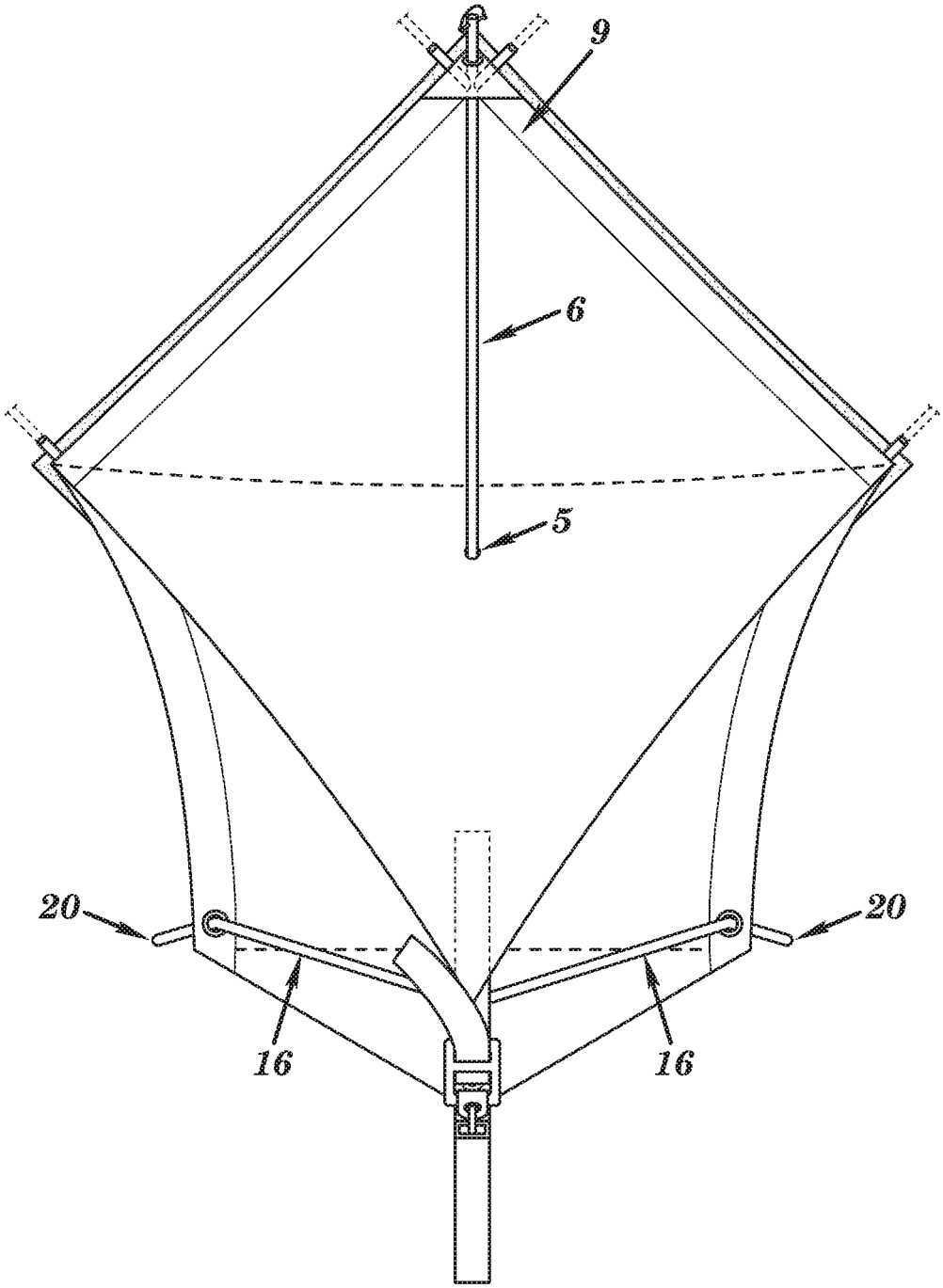
FIG. 3A is a view from the rear of the deployed sign assembly of the center mast support frame member engaged to the fabric
Figure 3A:
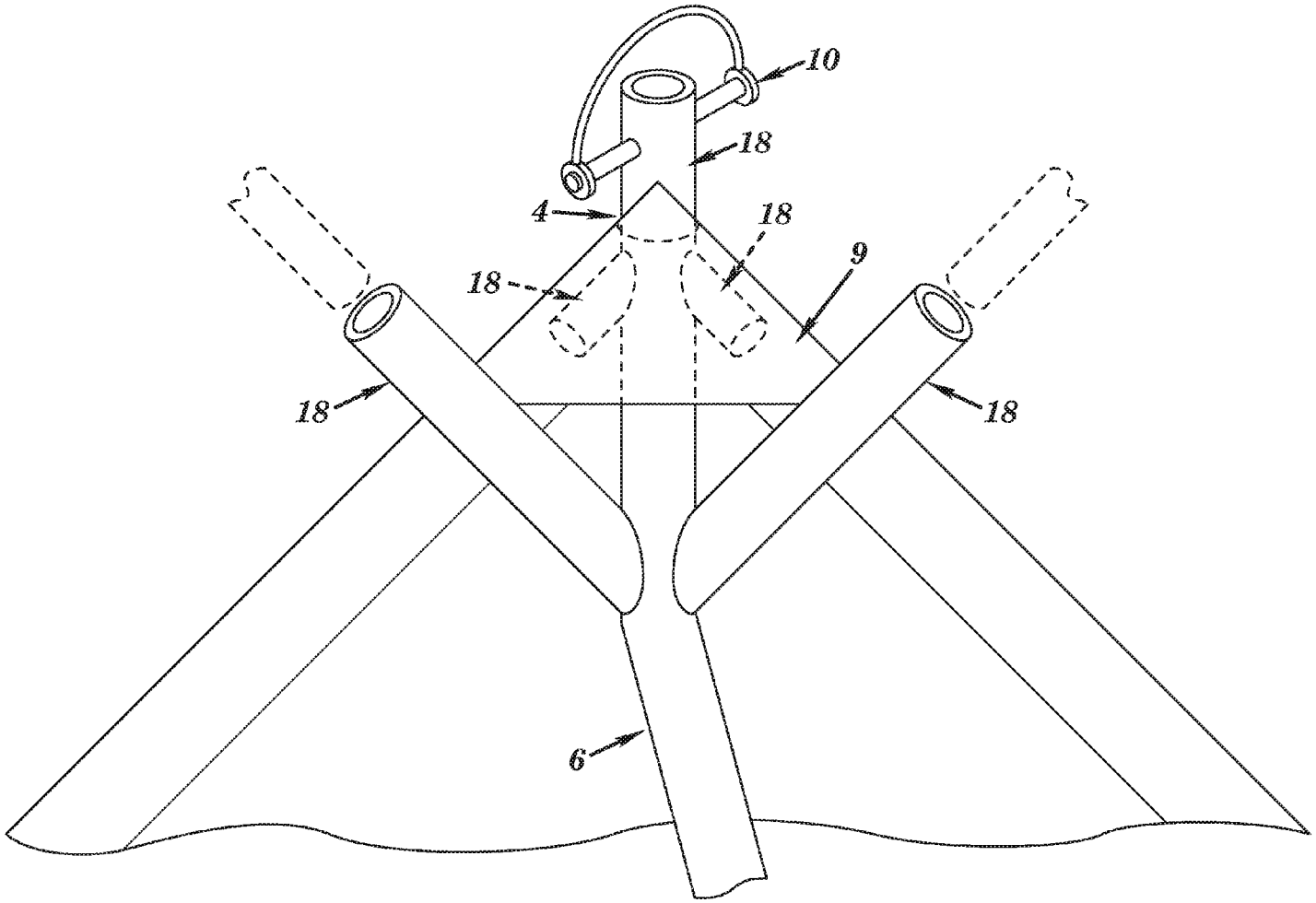

The main sheet (1) possesses five reinforced holes (4) located at the apex points of the main sheet's polygon shape into which the sign assembly support frame members are inserted. The triangle-shaped upper flap (2) is attached to the main sheet (1) by stitching, glue or other similar connective means. As shown in FIGS. 3A and 4A, the upper flap (2) has a receiving pocket (9) and reinforced hole (4) located at upper flap apex point opposite of the upper flap's connection to the main sheet (1). The adjustable tension strap (3) includes a hole (11) to allow its connection to the articulating rear base leg (12) with a clasp (13), or other similar connective means. The adjustable tension strap (3) also includes a buckle (14) enabling a user to shorten or lengthen the length of the strap (3) between the main sheet (1) and the articulating rear base leg (12), thereby lessening or increasing the amount of the tension between the sign assembly support frame and fabric when the sign assembly is in and expanded or deployed state.

Figure 4:
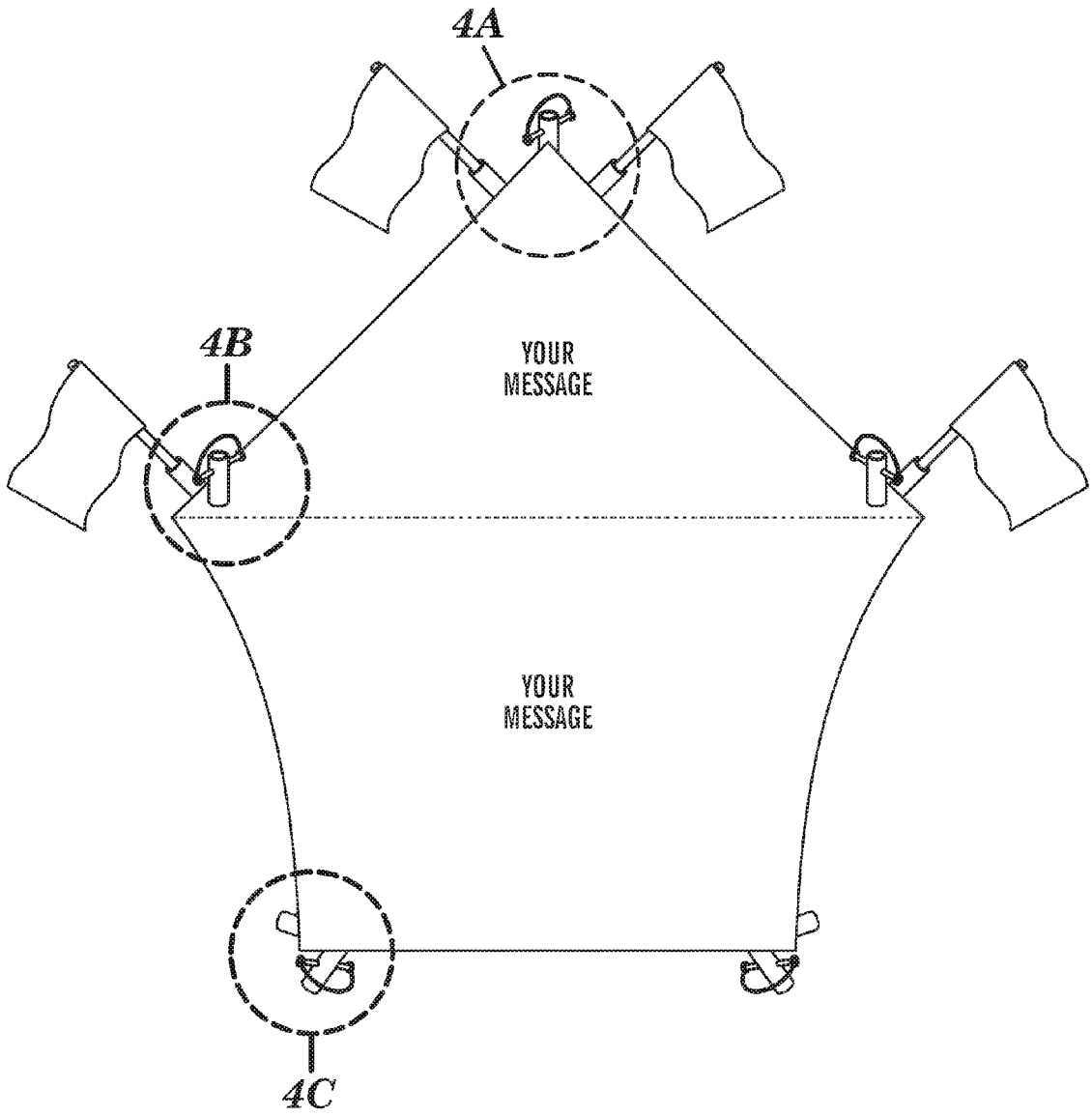
FIG. 4 is a front view of the sign assembly in its expanded or deployed state with the fabric including a permanently imprinted display message.
Figure 4A:
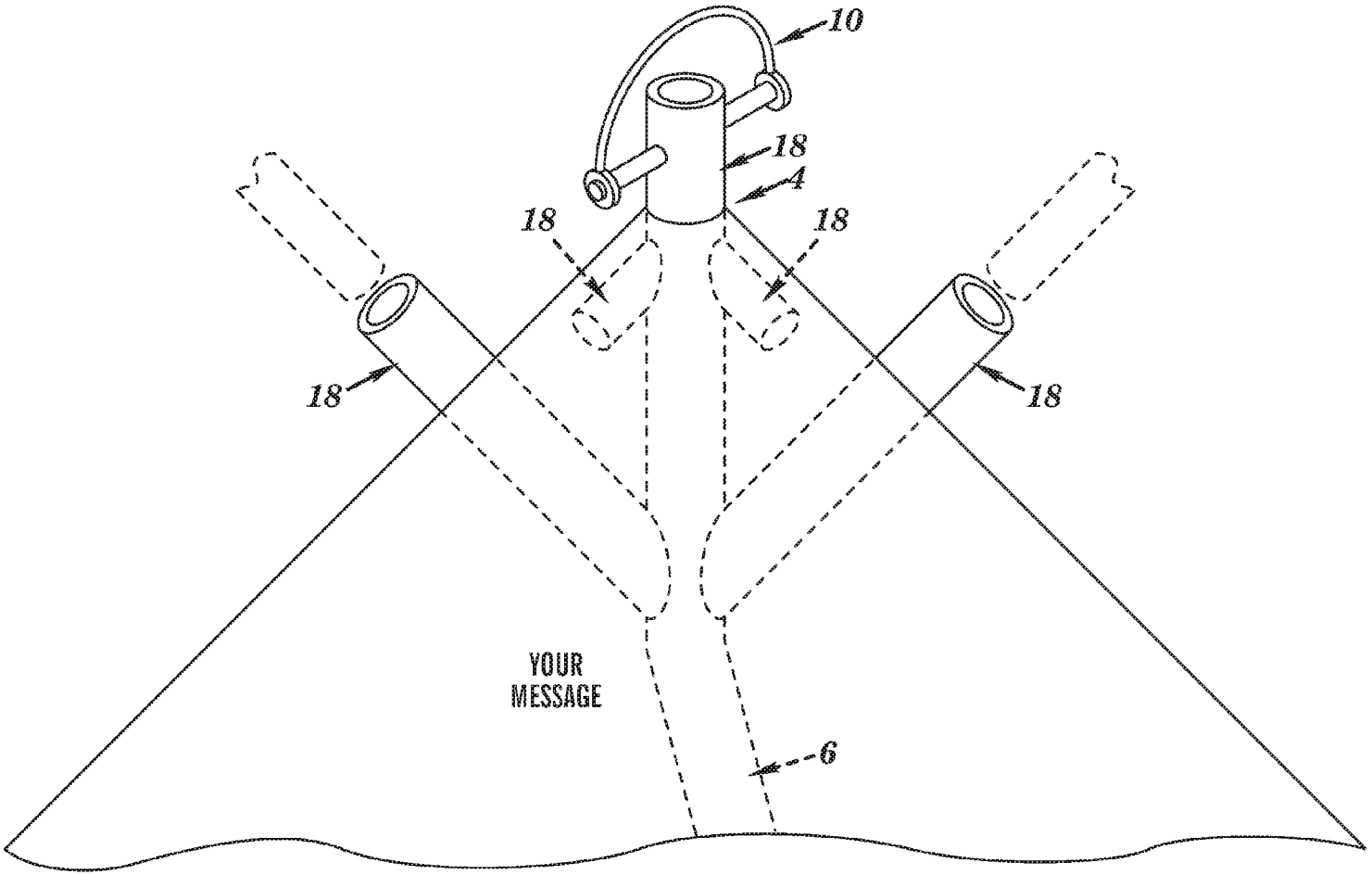
FIG. 4A is a view from the front of the deployed sign assembly of the center mast support frame member prongs and D-ring containment pin
Figure 4B:
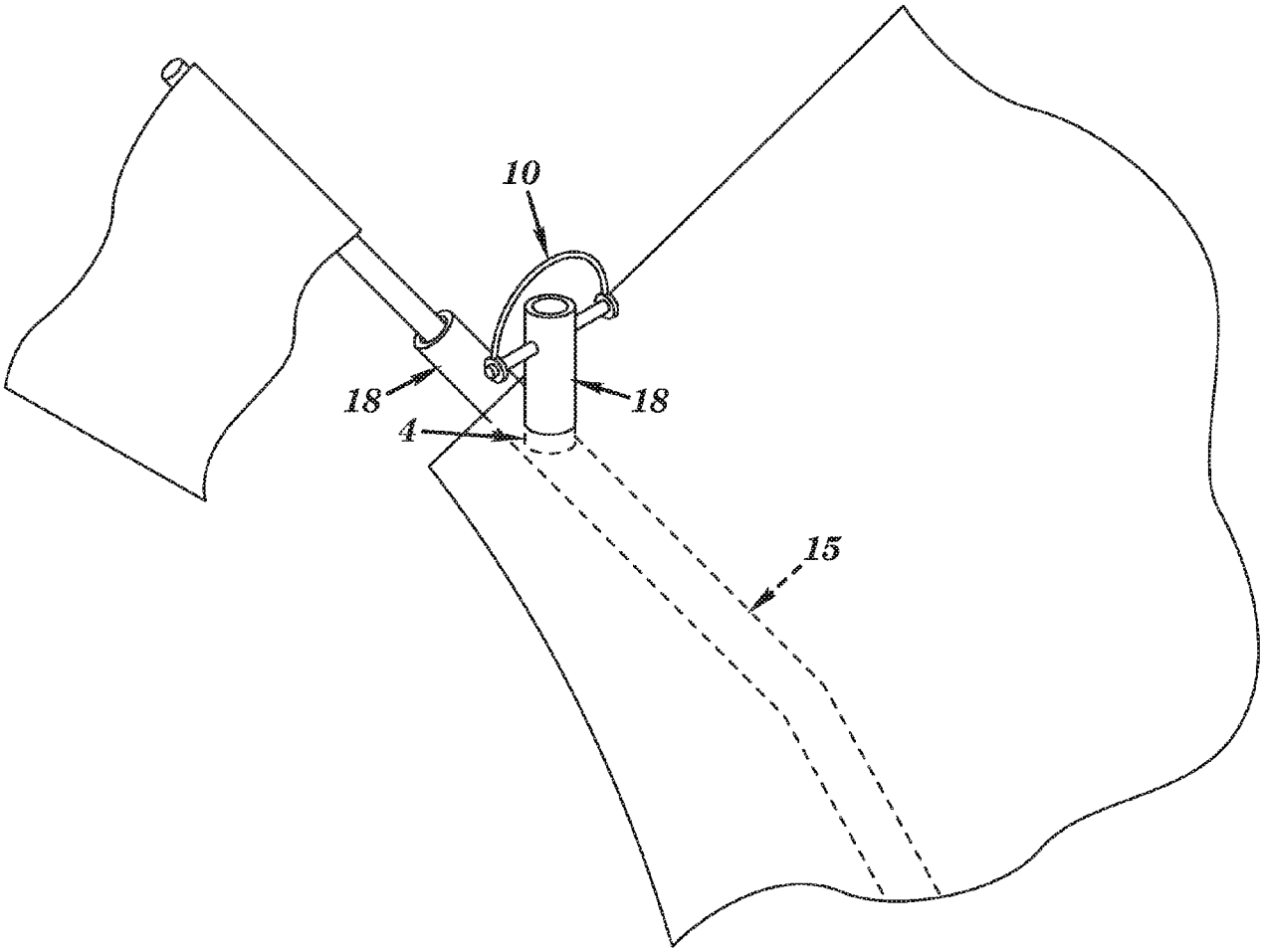
FIG. 4B is a view from the front of the deployed sign assembly of an upper extension arm support frame member prongs and D-ring containment pin
Figure 4C:
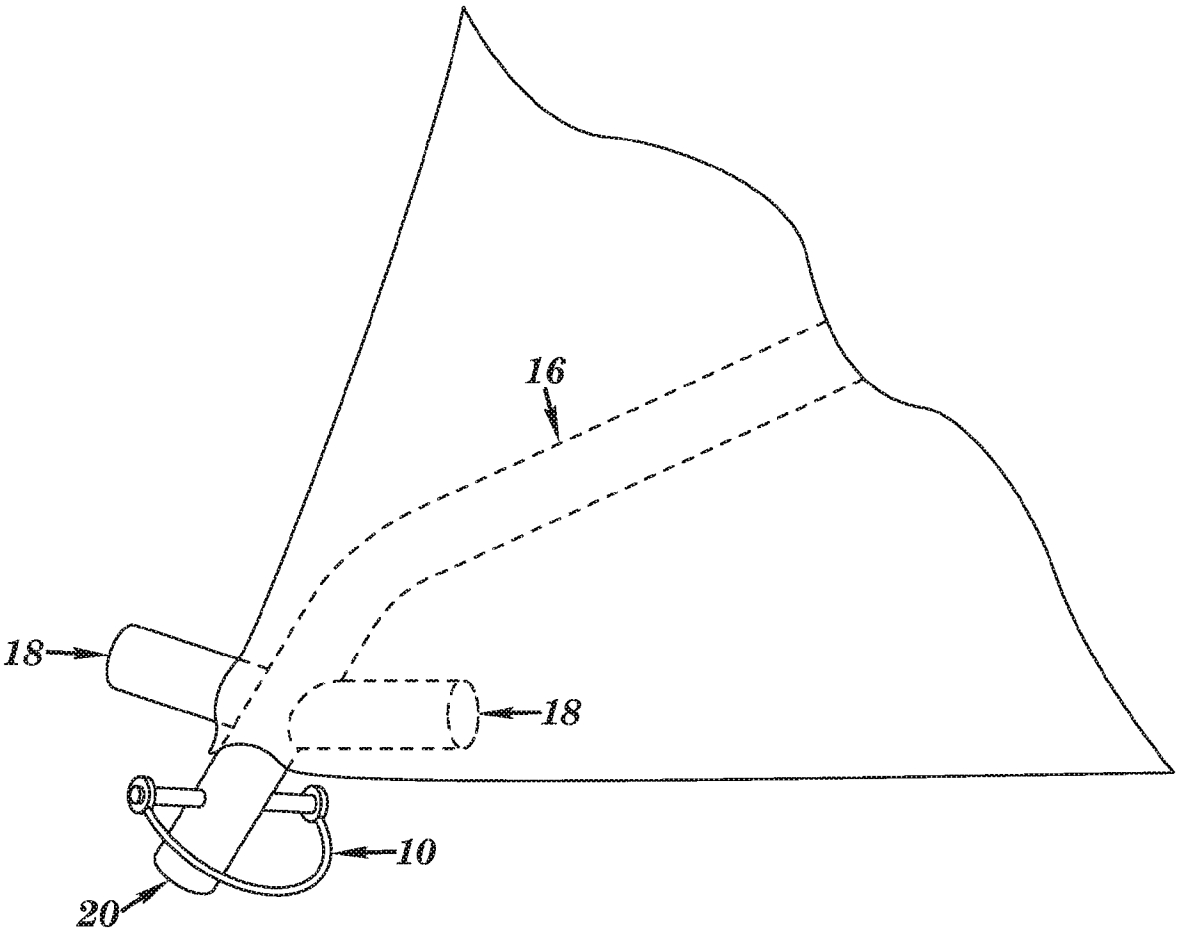
FIG. 4C is a view from the front of the deployed sign assembly of lower leg extension support frame member prongs and D-ring containment pin

FIGS. 2 through 5 are views of the sign assembly in its expanded or deployed state. The sign assembly support frame members include two upper arm extension support frame members (15), a center mast support frame member (6), two lower leg extension support frame members (16), a center shaft support frame member (17), and the articulating rear base leg (12). The support frame members can be constructed with circular or rectangular hollow lightweight metal tubing. In addition to lightweight metal tubing, the support frame members could be comprised of plastic or composite depending on what yields the optimal manufacturing and performance combination when all relevant factors are considered. The two upper arm extension (15), center mast (6), and two lower leg extension (16) support frame members each have endings equipped with two or more prongs or tabs (18). FIGS. 3*a* and 4*a* provide front and rear views of the five prongs (18) on the center mast support frame member (6). FIG. 4*b* is a view of the two prongs (18) on the one of the two upper arm extension support frame members (15), with the upper arm extension support frame member on the other side of the sign assembly having the same two-prong design. FIG. 4*c* shows the three prongs (18) on one of the two lower leg extension frame support members (16), with the lower leg extension support frame member on the other side of the sign assembly having the same three prong design. As shown in FIGS. 3*a*, 4*a*, 4*b* and 4*c*, the two upper arm extension (15), center mast (6) and two lower leg extension (16) support frame members each have a single prong (18) which is inserted into the fabric holes (4). When the sign assembly is expanded or deployed, the prongs (18) serve to fix the position of the fabric against each of the support frame members and prevent the fabric from moving in the direction along the support frame members towards the sliding carriage (8). This causes the fabric to stretch across the expanded support frame, thereby creating and maintaining a tension relationship between the fabric and the sign assembly support frame. Each of the prongs (18) which are inserted into the fabric holes (4) are equipped with a D-ring containment pin (10) which can be opened to allow removal of the D-Ring containment pin (10) from the prong (18). The D-ring containment pins (10) are placed on the prongs (18) of the support frame members to maintain the support frame members properly positioned within the fabric holes (4). In the event the fabric needs to be exchanged, repaired or replaced, the D-ring containment pins (10) can be removed from the prongs (18), thereby enabling the sign assembly support frame members to be removed from the fabric holes (4) and disengaged from the fabric. In one embodiment in which the fabric includes a permanently imprinted display sign message as shown in FIG. 4, removal of the fabric enables different fabrics to be interchanged on the support frame depending on which imprinted message is desired for display on the sign assembly. Additionally, when the sign assembly is in its collapsed state and no tension exists between the fabric and the support frame, the D-ring containment pins (10) maintain the connection between the sign assembly support frame and fabric by keeping the support frame members inserted in the fabric holes (4).

As shown in FIGS. 2, 3, 7 and 9, a center mast slot hole (5) on the fabric main sheet (1) provides a path through which the center mast support frame member (6) runs from a semi-circular channel guide (7) on the sliding carriage (8) to the upper flap support frame receiving pocket (10) and fabric hole (4) located on the upper flap (2).

Figure 2:
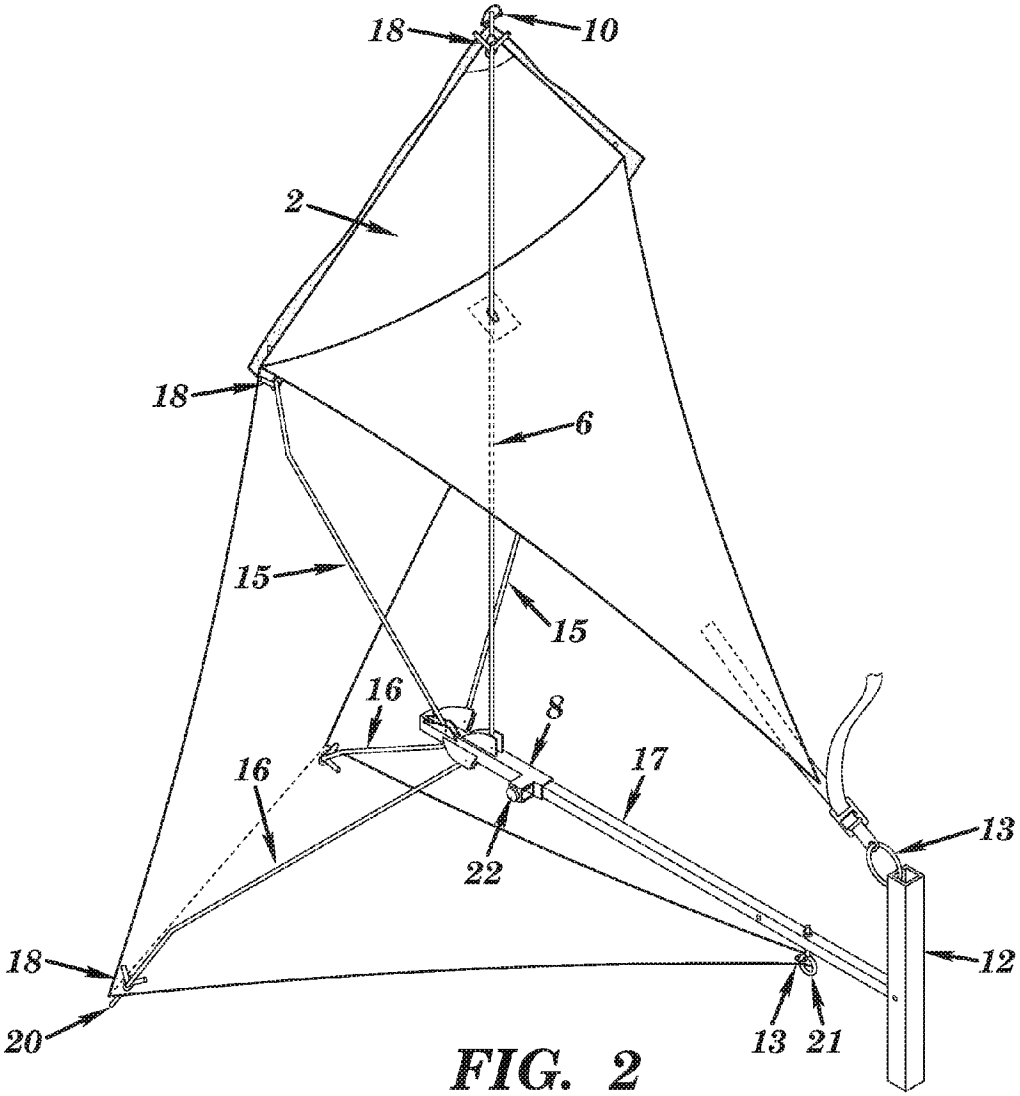
FIG. 2 is a side view of the sign assembly in its expanded or deployed state.
Figure 7:
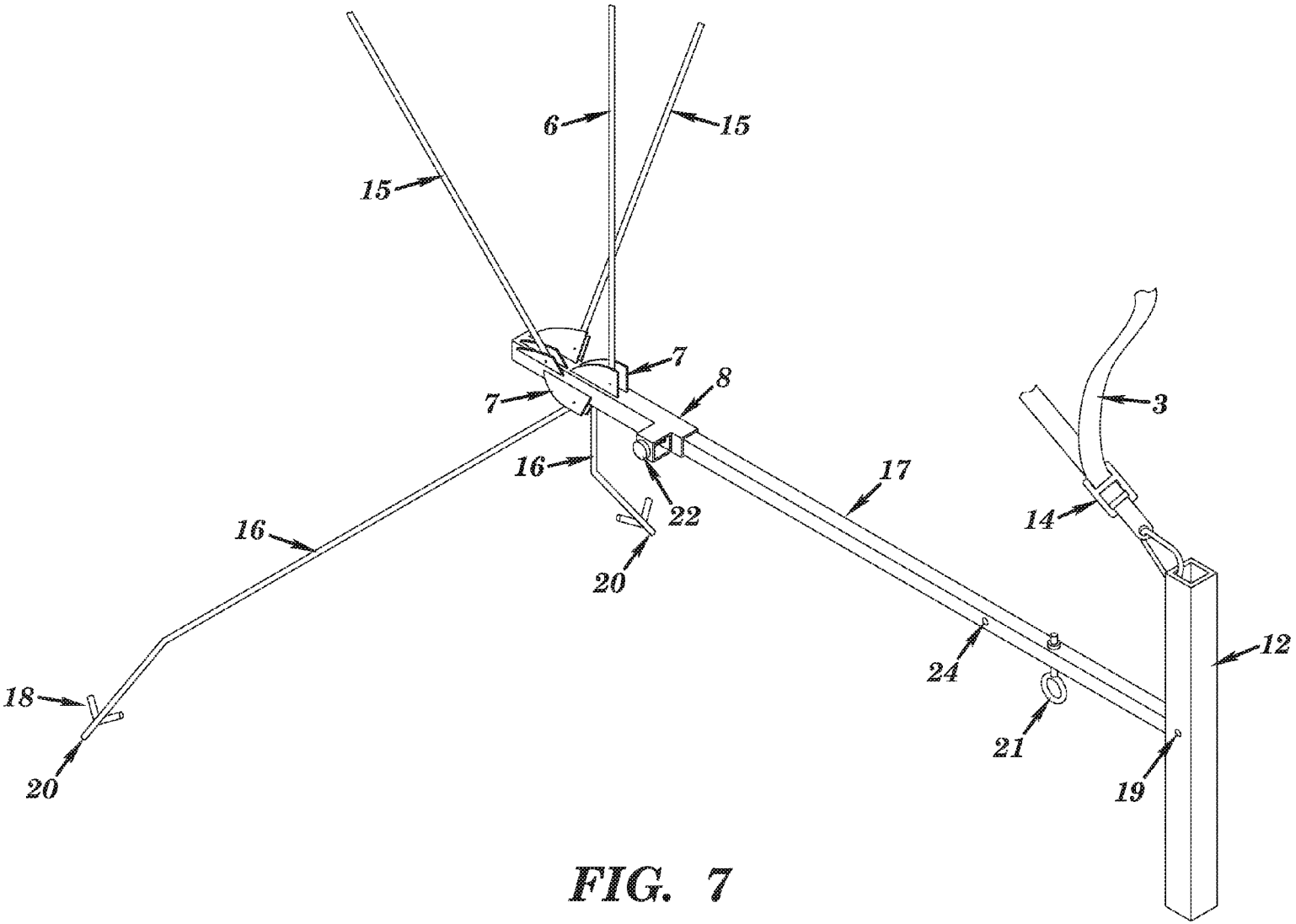
FIG. 7 is a view of the sign assembly support frame, sliding carriage, support frame member semi-circular channel guides and articulating rear base leg.
Figure 9:
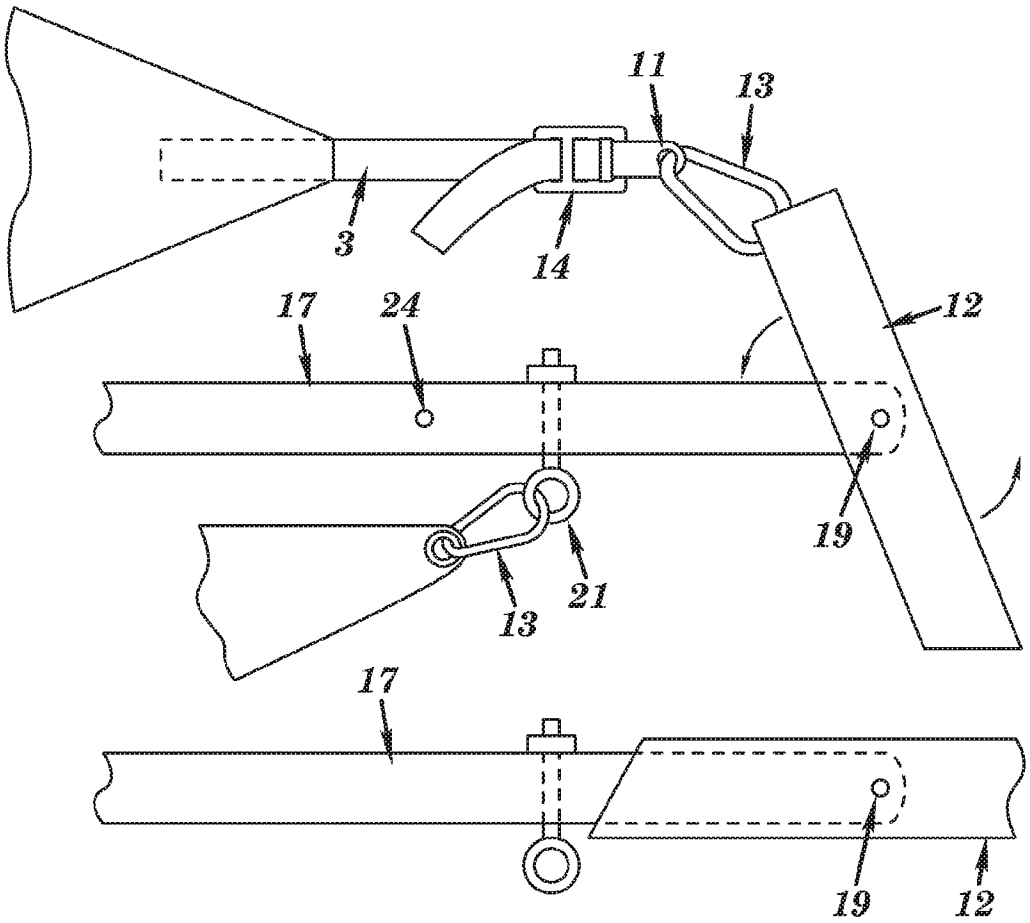
FIG. 9 is a view of the center shaft support frame member, articulating rear base leg, rear base leg fabric clasp, tension adjuster strap, tension adjuster strap hole, and tension strap buckle.

FIGS. 2, 7 and 9 provide a view of the articulating rear base leg (12) which is connected to the center shaft support frame member (17) by a connecting pin (19). The articulating rear base leg connecting pin (19) also serves as a pivot point about which the articulating rear base leg (12) can rotate. As shown in FIG. 9, the articulating rear base leg (12) is able to rotate from being parallel to the center shaft support frame member (17) to a fixed position when the sign assembly is deployed, where no further rotation is possible, in which the lower end of the articulating rear base leg (12) is pointed away from the sign assembly. Each of the two lower leg extension support frame members (16) has an end which is curved at an angle in the range of forty to seventy-five degrees towards the bottom of the sign assembly for the purpose of comprising two front ground support points (20) for the sign assembly base. The two lower leg extension support frame members' front ground support points (20) combine with the articulating rear base leg (12) in its fixed position to comprise a tripod base which supports the sign assembly on the ground when deployed. The center shaft support frame member (17) is connected to the sign assembly fabric via a clasp (13) attached to a fabric hole (4) and an eye ring (21) located on the center shaft support member (17). The center mast support frame member (6) runs from a semi-circular channel guide (7) on the sliding carriage (8) through the center mast slot hole (5) in the fabric main sheet.

Figure 8:
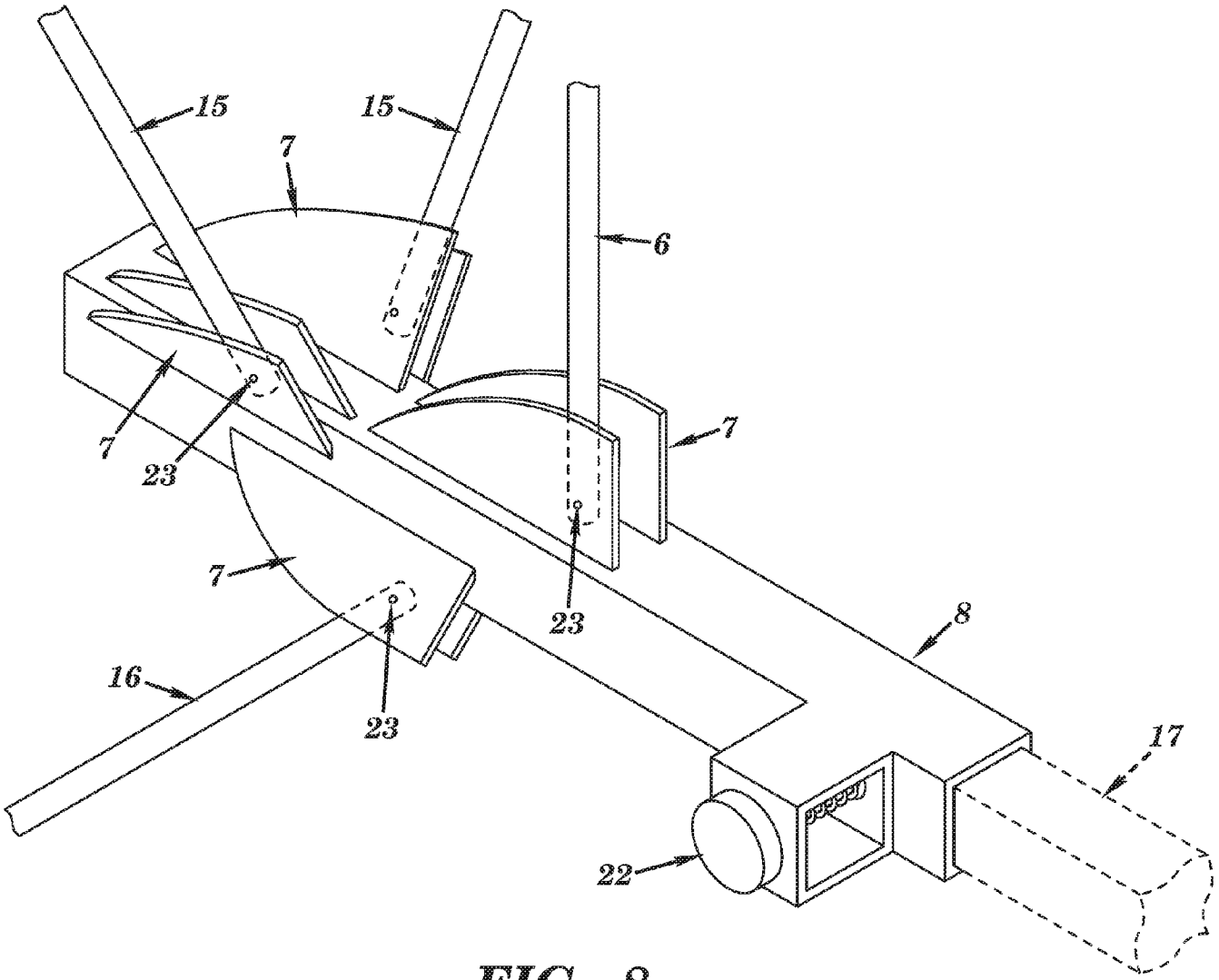
FIG. 8 is a close up view of the sliding carriage and center shaft support frame member.

FIGS. 7 and 8 illustrate a sliding carriage (8) located on the center shaft support frame member (17). The sliding carriage (8) is constructed in a hollow shape so as to allow it to slide back and forth on the center shaft support frame member (17). Similar to the support frame members, the sliding carriage (8) is comprised of lightweight metal, plastic, or composite. The sliding carriage (8) includes a spring-loaded pop pin mechanism (22) which allows the sliding carriage (8) to be secured to two specific locations on the center shaft support frame member (17) with drilled holes into which the spring-loaded pop pin mechanism (22) will engage when the sign assembly is in a collapsed or expanded state. The spring-loaded pop pin mechanism (22) will engage in the center shaft support frame member forward hole (25) when the sign assembly is in its expanded or deployed state, and in the center shaft support frame member rear hole (24) in its collapsed state. Upon engagement of the pop pin mechanism (22) into either of the two drilled holes on the center shaft support frame member (17), the sliding carriage (8) remains stationary and the position of the sliding carriage (8) on the center shaft support frame member (17) remains fixed.

The sliding carriage (8) also possesses five semi-circular channel guides (7) which serve as connective pivot points for the two upper arm extension frame support members (15), two lower leg extension frame support members (16), and the center shaft frame support member (17) to the sliding carriage (8). As shown in FIG. 8, these five support members each connect to one of the semi-circular channel guides (7) via a connecting pin (23). While the connecting pins (23) allow these five support frame members to move, the semi-circular channel guides (7) restrict the possible movement of each of the five support members to a rotational direction of motion defined by the semi-circular channel guide (7). The motion restriction of the support frame members to a defined rotational direction of motion, due to the semi-circular channel guides (7), ensures that the support frame members move in the direction required to support proper expansion of the sign assembly as the sliding carriage (8) is moved forward on the center shaft support frame member (17) during expansion or deployment of the sign assembly.

In order to expand the sign assembly from a collapsed state, the articulating rear base leg (12) is rotated from its position parallel to the center shaft support frame member (17) about its connective pivot point (19) to a position where no further rotation is possible in which in which the lower end of the articulating rear base leg (12) is pointed away from the sign assembly. The spring-loaded pop pin mechanism (22) on the sliding carriage (8) is disengaged from the rear hole (24) on the center shaft support frame member (17) and the sliding carriage (8) is pushed forward to the location on the center shaft support frame member (17) where the motion of the sliding carriage (8) stops and the location of the sliding carriage (8) becomes fixed due to the engagement of the spring-loaded pop pin mechanism (22) into the center shaft support frame member forward hole (25). The location of the forward hole (25) on the center shaft support frame member (17) into which the spring-loaded pop pin mechanism (22) engages is the location on the center shaft support member (17) which causes the sign assembly support frame members and fabric to be at a sufficient tension relationship so that the sign assembly is properly expanded. Because the position of the sliding carriage (8) and, therefore, the positions of the sign assembly support frame members are now fixed, the tension between the sign assembly support frame and the sign assembly fabric can be adjusted by tightening or loosening the adjustable tension strap (3) to ensure that the message being displayed on the fabric is properly positioned. The adjustable tension strap (3), by being connected to the fabric main sheet (1), can increase or decrease the tension between the fabric main sheet (1) and the sign assembly support frame by varying the length of the tension strap (3) between the fabric main sheet (1) and the articulating rear base leg (12). The adjustment of the adjustable tension strap (3) by movement of the buckle (14) enables a user to vary the tension between the fabric main sheet (1) and the support frame members. Furthermore, because the center mast support frame member (6) both travels through the center mast slot hole (5) in the main sheet (1) and is directly connected to the upper flap (2), any adjustment of the tension strap (3) length directly causes movement in the fabric main sheet (1) which also forces the center mast support frame member (6) to move, causing movement of the fabric upper flap (2). This design causes a tension relationship to exist between all parts of the sign assembly fabric and support frame when the sign assembly is expanded or in a deployed state, thereby allowing the adjustment of both the fabric main sheet (1) and the upper flap (2) by adjustment of the tension strap (3) connective length between the fabric and the articulating rear base leg (12).

In its expanded or deployed state, the sign assembly's resistance to potential movement caused by wind or air currents created by passing vehicles is enhanced due to two design characteristics that enable the height of the sign assembly's center of gravity to be lowered. First, the sign assembly is designed to allow the placement of a majority of the sign assembly's weight in a relatively low position as compared to the overall height of the deployed sign assembly. Because the sign assembly is comprised of lightweight fabric material and a support frame, the height of the sign assembly's center of gravity can be adjusted to maximize wind resistance by varying the weights of certain relatively lower-placed components of the support frame, such as the center shaft support frame member (17), sliding carriage (8), and semi-circular channel guides (7). By increasing the weight of these lower-placed support frame components, the sign assembly's center of gravity can be lowered to increase stability of the sign assembly in its expanded or deployed state and increase its resistance to movement caused by wind. Additionally as shown in FIG. 2, the portion of the fabric main sheet (1) below the center shaft support frame member (17) can be conveniently used as a location on which weighted objects can be placed to increase the weight of the sign assembly, thereby further enhancing the sign assembly's wind resistance.

Figure 10:
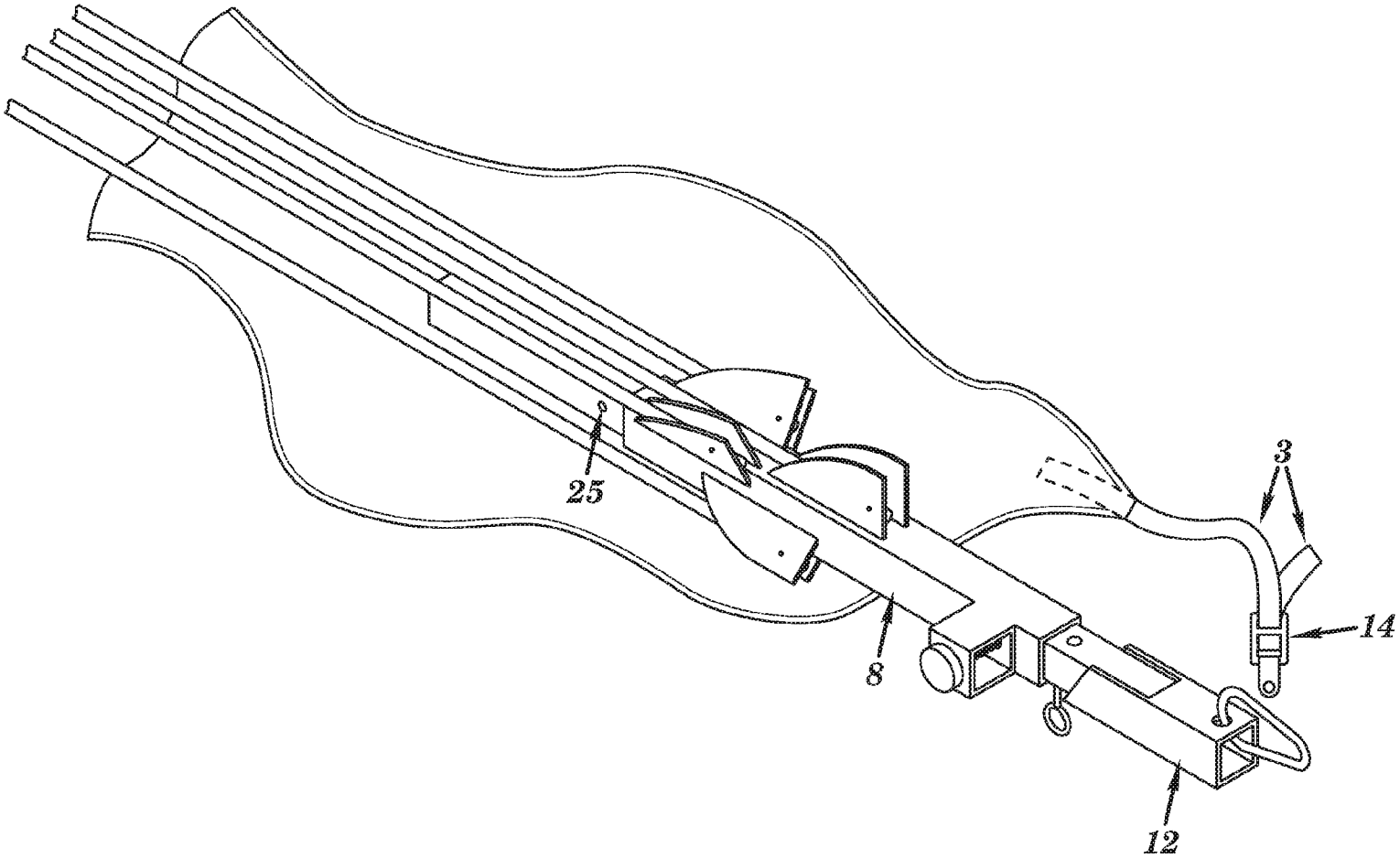
FIG. 10 is a view of the present invention in its collapsed state.

In order to transition from a deployed to collapsed state, the spring-loaded pop pin mechanism (22) is disengaged from the center shaft support member forward hole (25) thereby freeing the sliding carriage (8) from its fixed position and allowing the sliding carriage (8) to slide to the rear towards the articulating rear base leg (12). The motion of the sliding carriage (8) towards the rear base leg (12) continues until the motion of the sliding carriage (8) stops and the location of the sliding carriage (8) becomes fixed due to the engagement of the spring-loaded pop pin mechanism (22) into the center shaft support frame member rear hole (24). At this point, the position of each support frame member is parallel, or nearly parallel, to one another thereby causing the sign assembly to transition from its deployed shape to an approximate cylindrical shape which may be easily stored, carried and transported in a nylon sign assembly carrying bag by a single person. FIG. 10 is a view of the sign assembly in its collapsed state.

In one embodiment of the above described sign assembly, a message is permanently imprinted on the fabric. Different messages can be displayed on the sign assembly by interchanging fabrics having different permanently imprinted messages to the sign assembly support frame. FIG. 4 is a front view of this embodiment.

Figure 5:
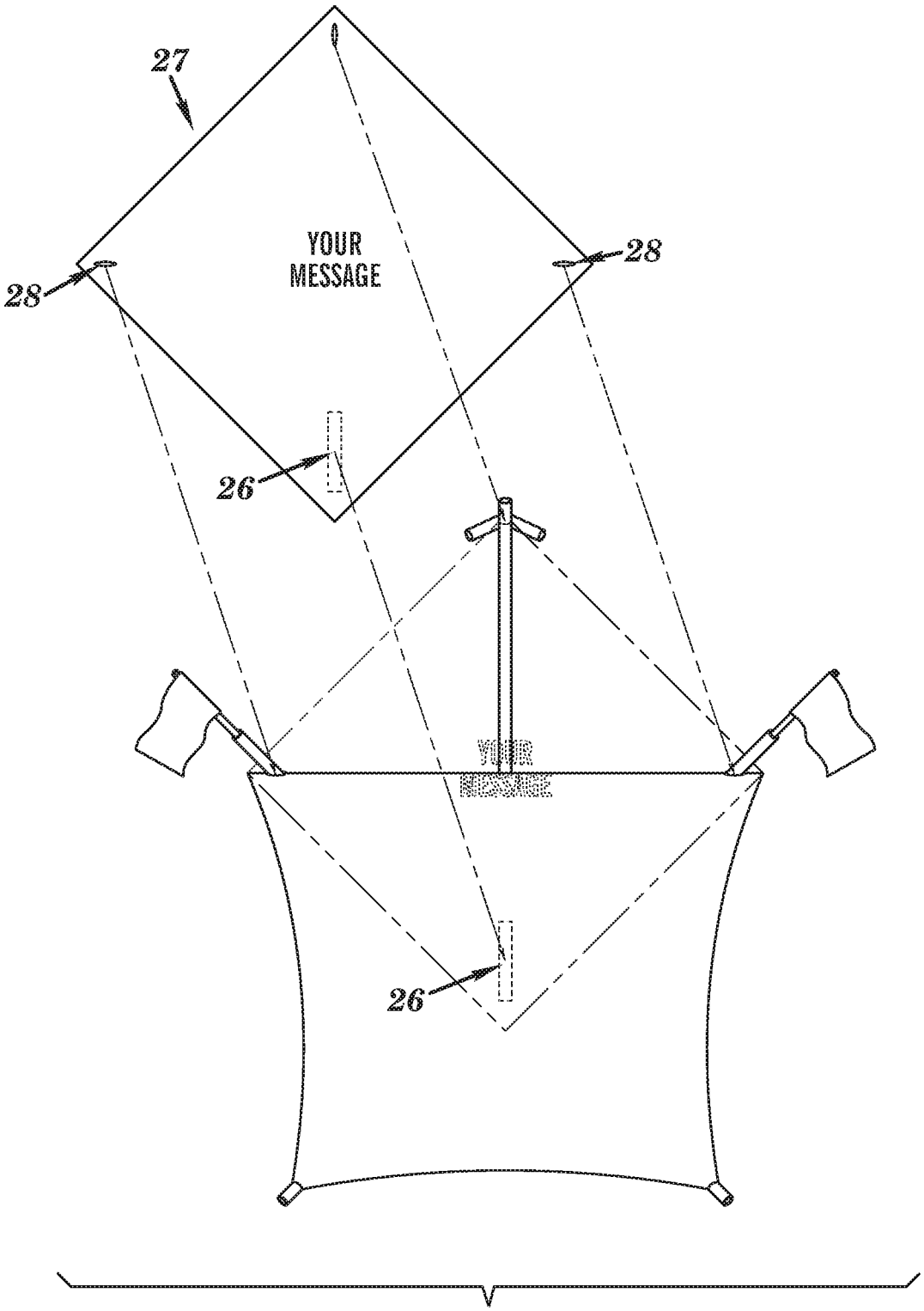
FIG. 5 is a front view of the sign assembly in its expanded or deployed state with a changeable display message and traffic flags.
Figure 5A:
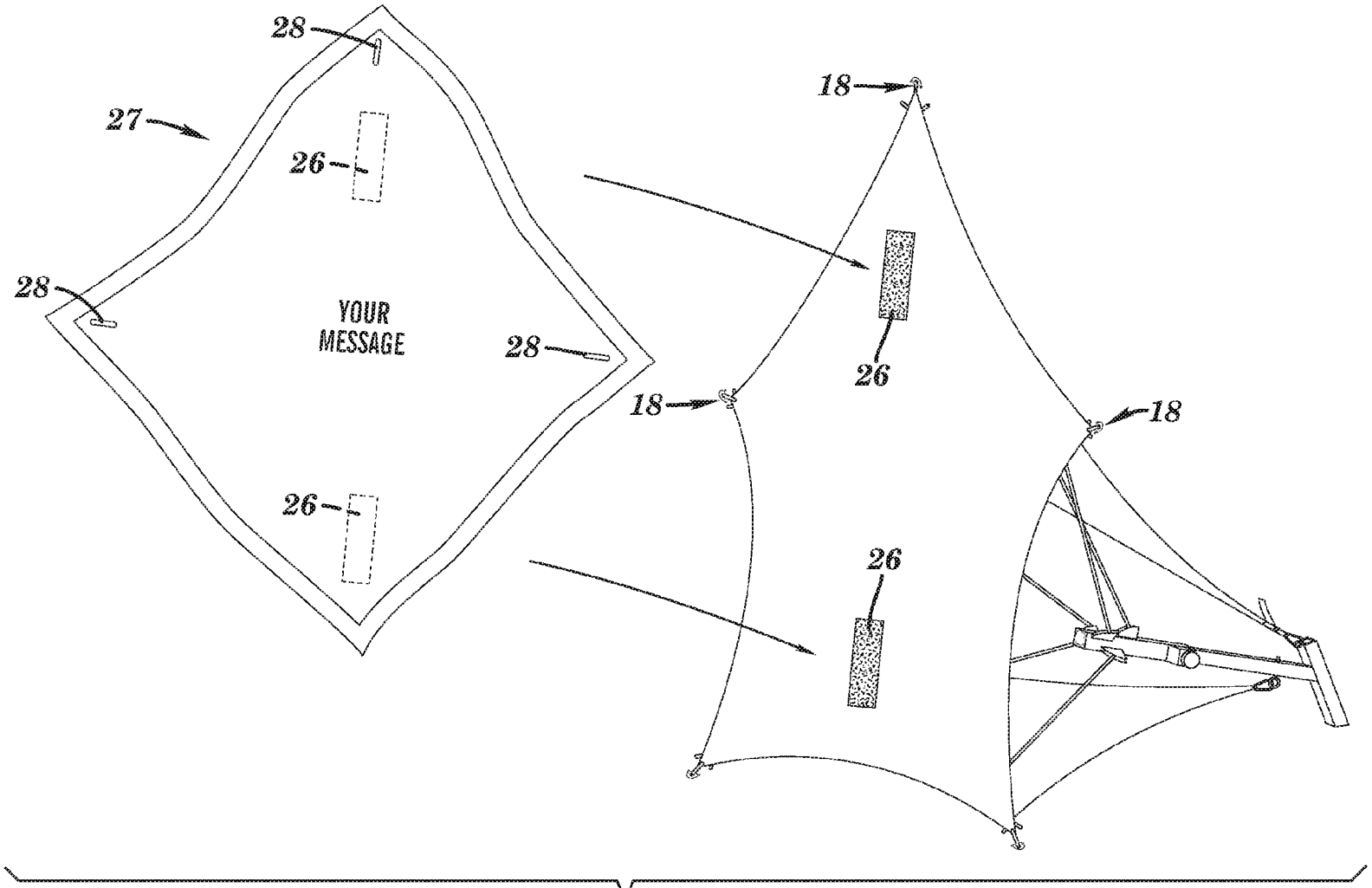
FIG. 5A is a view of the sign assembly and a changeable display message.
Figure 6:
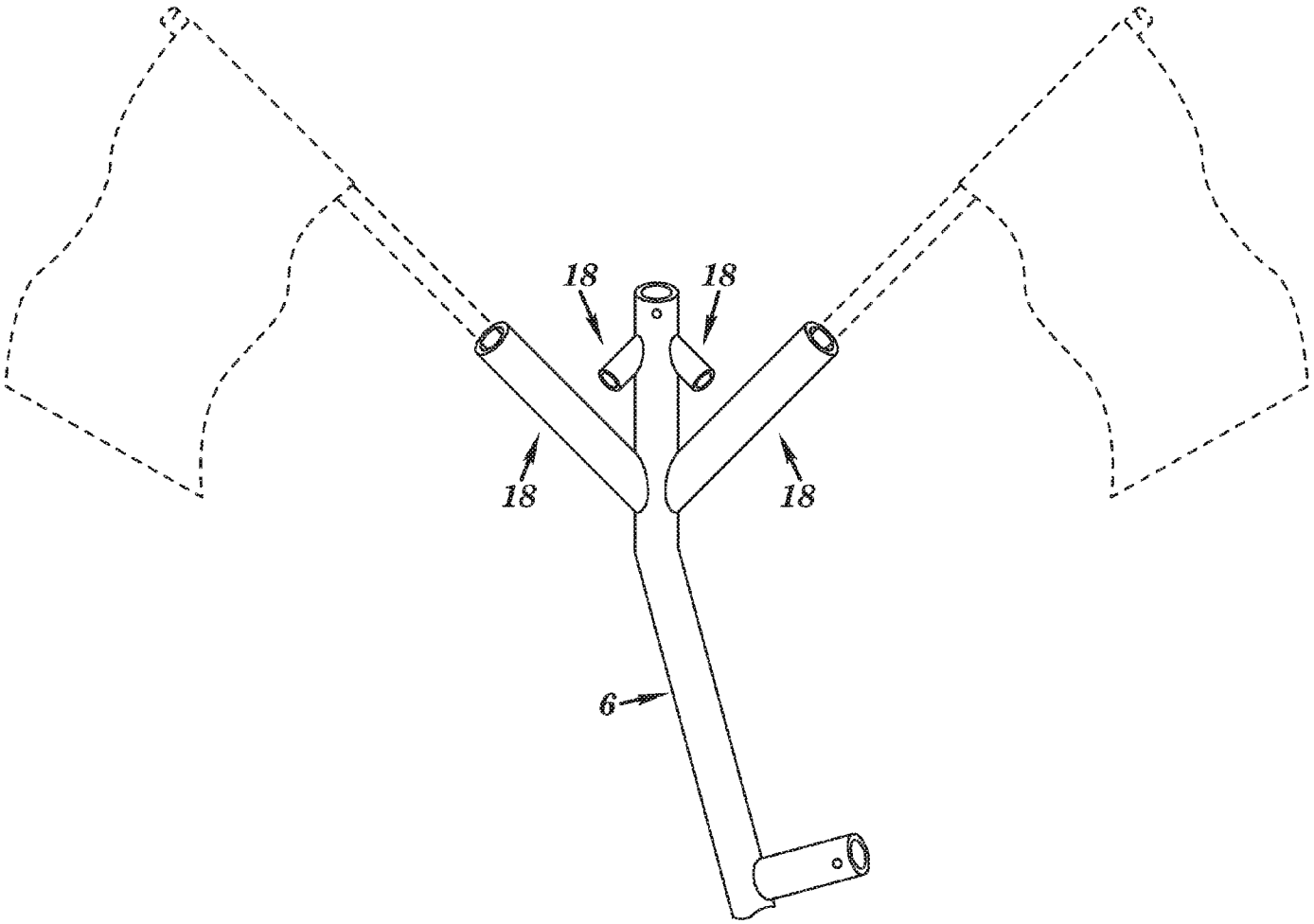
FIG. 6 is a view of the prongs on the center shaft support frame member accepting traffic flags for display.

Another embodiment of the sign assembly has no message imprinted on the fabric. In this design, the fabric includes Velcro strips (26), or other similar attachment means, on both the upper flap (2) and main sheet (1). Interchangeable display signs (27) possessing Velcro strips (26) on the back of the display messages, which geometrically match the Velcro strips (26) on the main sheet (1) and upper flap (2), can be attached to and removed from the sign assembly fabric. Additionally, the interchangeable display signs (27) are equipped with three reinforced slots (28) geometrically aligned with the prongs (18) on the center mast (6) and two upper arm extension (16) support frame members, thereby enabling attachment of the interchangeable display signs (27) to the prongs (18). The interchangeable display signs (27) can be made of the same material as the sign assembly fabric. The interchangeable display signs are shaped and sized to comply with applicable government regulations for road signs. This embodiment enables rapid interchange of multiple display sign messages on the sign assembly. FIGS. 5 and 5A are front views of this embodiment utilizing both Velcro strips (26) on the fabric and the sign assembly support frame member prongs to enable attachment of an interchangeable display sign (27) having Velcro strips (26) and slots (28) geometrically aligned to the sign assembly prongs (18).

Another embodiment of the sign assembly is presented in which the prongs (18) located on the upper arm extension (15) and center mast support frame (6) members are equipped to allow the placement of additional display signs or flags on the prongs (18). As in all embodiments, one prong (18) on each of the two upper arm extension (15) and center mast (6) support frame members is equipped with a D-ring containment pin (10) to maintain the support frame member inserted in the fabric hole (4) and the other prongs (18) can be used to hold the additional display messages or flags. However, in this embodiment, the prongs without a D-ring containment pin have a hollow structure and are of sufficient length to enable the insertion of the additional display signs or flags into the sign assembly prongs (18). The support posts of the additional display signs or flags are shaped to allow insertion of the additional signs or flags directly into the prongs (18). FIGS. 4, 4B, 5 and 6 are views of this design with traffic flags attached to prongs (18) of the two upper arm extension (15) and center mast (6) support frame members.

From the foregoing detailed description, one skilled in the art will readily recognize that the present invention provides a portable and collapsible sign assembly having a fabric and support frame in tension with one another which is positionable between an expanded and collapsed state. While the present invention has been disclosed by describing and illustrating various embodiments, those skilled in the art will readily recognize from the foregoing discussion and the accompanying drawings and claims, that changes, modifications and variations can be made herein without departing from the spirit and scope of the invention as defined in the following claims.

The invention claimed is:

1. A portable collapsible sign assembly comprising:

a fabric wherein said fabric includes fabric holes, a support frame having more than one support frame member wherein said support frame is adjustable between a collapsed position and an expanded position, wherein said fabric and support frame members are in a tension relationship when said support frame is in an expanded position, wherein said fabric includes means to connect the fabric and one support frame member and the length of said means to connect the fabric and one support member can be adjusted, wherein an adjustment of the length of said means to connect the fabric and one support frame member when the support frame is an expanded position results in an adjustment of the tension relationship between the fabric and support frame, wherein when the support frame is in an expanded position the base of the sign assembly is comprised of at least three support frame members and the support frame members which comprise the base of the sign assembly contact the surface on which the sign assembly is positioned, a non-rotating sliding carriage wherein said sliding carriage is installed on one support frame member and said sliding carriage is able to move along the length of the one support frame member on which the sliding carriage is installed, wherein said sliding carriage is connected to five support frame members, wherein said sliding carriage includes channel guides and said channel guides limit the movement direction of each of the five support frame members connected to the sliding carriage.

2. The portable collapsible sign assembly according to claim 1, wherein the fabric is positioned to allow and accept the placement of objects which remain stationary on the fabric when the support frame is in its expanded position and the shape of the fabric causes the weight of such objects to be distributed among the support frame members of which the base of the sign assembly is comprised.

3. The portable collapsible sign assembly according to claim 1, wherein at least three of the support frame members are inserted into the fabric holes and said support frame members inserted into the fabric holes possess means to maintain the support frame members inserted into the fabric holes when the support frame is in the collapsed position and expanded position.

4. The portable collapsible sign assembly according to claim 3, wherein the support frame members inserted into fabric holes include prongs and said prongs are the means to fix the position of the fabric on said support frame members inserted into the fabric holes when the support frame is in the expanded position.

5. The portable collapsible sign assembly according to claim 4, wherein four support frame members each possess at least two prongs, wherein said prongs on two support frame members in combination with another support frame member form a base when the support frame in in the expanded position.

6. The portable collapsible sign assembly according to claim 5, wherein a pop pin mechanism on the sliding carriage in combination with two holes drilled into the support frame member on which the sliding carriage is installed is said means to fix the position of the sliding carriage in one position in which the support frame is in the expanded position and another position in which the support frame is in the collapsed position.

7. The portable collapsible sign assembly according to claim 3 wherein the support frame members inserted into fabric holes include D-ring containment pins and said D-ring containment pins are the means to maintain the support frame members inserted into the fabric holes when the support frame is in the collapsed position.

8. The portable collapsible sign assembly according to claim 1, wherein said sliding carriage includes a means to fix the position of said sliding carriage on the support frame member on which said sliding carriage is installed in one position in which the support frame is in the expanded position and another position in which the support frame is in the collapsed position.

9. The portable collapsible sign assembly according to claim 1, wherein the fabric includes a permanently imprinted message.

10. The portable collapsible sign assembly according to claim 1, wherein the fabric includes means to attach different messages to said fabric.

11. The portable collapsible sign assembly according to claim 1, wherein the fabric includes a main sheet and upper flap.

12. The portable collapsible sign assembly according to claim 11, wherein said means to connect the fabric and one support frame connects the main sheet to one support frame member and an adjustment of the length of said means causes movement in the main sheet, upper flap and support frame.

13. A portable collapsible sign assembly comprising:

a fabric wherein said fabric includes fabric holes, a support frame having more than one support frame member wherein said support frame is adjustable between a collapsed position and an expanded position, wherein said fabric and support frame members are in a tension relationship when said support frame is in an expanded position, wherein said fabric includes means to connect the fabric and one support frame member and the length of said means to connect the fabric and one support member can be adjusted, wherein an adjustment of the length of said means to connect the fabric and one support frame member when the support frame is an expanded position results in an adjustment of the tension relationship between the fabric and support frame, wherein when the support frame is in an expanded position the base of the sign assembly is comprised of at least three support frame members and the support frame members which comprise the base of the sign assembly contact the surface on which the sign assembly is positioned, wherein the means to connect the fabric to one support member is a strap, wherein the support frame members consist of two upper arm extension support frame members, two lower leg extension support frame members, a center mast support frame member, a center shaft support frame member, and an articulating rear base leg.

14. The portable collapsible sign assembly according to claim 13, wherein the strap connects the fabric to the articulating rear base leg.

15. The portable collapsible sign assembly according to claim 13, wherein each of the two upper arm extension support frame members possess at least two prongs, wherein each of the two lower leg extension support frame members possess at least two prongs, wherein the center mast support frame member possesses at least three prongs, wherein said prongs on the two lower leg extension support frame members in combination with the articulating rear base leg form a tripod base when the support frame is in the expanded position.

* * * * *